US008869424B2

(12) United States Patent
Hermann et al.

(10) Patent No.: US 8,869,424 B2
(45) Date of Patent: Oct. 28, 2014

(54) METHOD AND DEVICE FOR DRYING HUMID AIR

(71) Applicant: Etimex Technical Components GmbH, Rottenacker, DE (US)

(72) Inventors: Heinz Hermann, Biberach/Riss (DE); Adalbert Kasper, Stuttgart (DE)

(73) Assignee: Etimex Technical Components GmbH (DE)

( * ) Notice: Subject to any disclaimer, the term of this patent is extended or adjusted under 35 U.S.C. 154(b) by 0 days.

(21) Appl. No.: 13/921,427

(22) Filed: Jun. 19, 2013

(65) Prior Publication Data

US 2014/0000849 A1 Jan. 2, 2014

Related U.S. Application Data

(63) Continuation of application No. 13/817,328, filed as application No. PCT/DE2011/001615 on Aug. 18, 2011, now abandoned.

(30) Foreign Application Priority Data

Aug. 18, 2010 (DE) ..... 10 2010 034 715

(51) Int. Cl.

| | |
|---|---|
| ***F26B 11/00*** | (2006.01) |
| ***F28D 15/00*** | (2006.01) |
| ***D06F 58/20*** | (2006.01) |
| ***A47L 15/00*** | (2006.01) |
| ***A47L 15/48*** | (2006.01) |
| ***D06F 58/28*** | (2006.01) |

(52) U.S. Cl.

CPC ..... *F28D 15/00* (2013.01); *D06F 58/206* (2013.01); *A47L 15/0034* (2013.01); *A47L 15/483* (2013.01); *A47L 15/0047* (2013.01); *D06F 58/28* (2013.01); *A47L 15/481* (2013.01)

USPC ..... 34/486; 34/105; 34/210; 134/18; 134/107; 165/53

(58) Field of Classification Search

USPC ..... 34/424, 486, 104, 105, 201, 210, 218; 134/18, 105, 107, 182; 165/50, 53, 125

See application file for complete search history.

(56) References Cited

U.S. PATENT DOCUMENTS

| | | | | |
|---|---|---|---|---|
| 3,450,494 | A * | 6/1969 | Gaiser | 423/332 |
| 3,598,131 | A * | 8/1971 | Weihe, Jr. | 134/107 |

(Continued)

FOREIGN PATENT DOCUMENTS

| | | |
|---|---|---|
| DE | 195 22 307 | 1/1997 |
| DE | 198 13 924 | 9/1999 |

(Continued)

OTHER PUBLICATIONS

International Search Report of Jun. 6, 2012.

*Primary Examiner* — Steve M Gravini

(74) *Attorney, Agent, or Firm* — Gerald E. Hespos; Michael J. Porco; Matthew T. Hespos

(57) ABSTRACT

A method and an associated apparatus for drying moisture-laden air from a working chamber of a water-bearing machine, in particular a dishwasher, comprises: setting the temperature of the moisture-laden air in the working chamber to between 40° C. and 50° C., setting the temperature of a cooling medium in a heat exchanger to less than 20° C., and conducting the moisture-laden air, of which the temperature has been adjusted in this way, out of the working chamber through the heat exchanger.

10 Claims, 11 Drawing Sheets

(56) References Cited

U.S. PATENT DOCUMENTS

| | | | | |
|---|---|---|---|---|
| 3,704,170 | A | 11/1972 | Landwier | |
| 7,604,014 | B2 | 10/2009 | Paintner | |
| 7,676,954 | B2 * | 3/2010 | Classen et al. | 34/486 |
| 8,176,926 | B2 | 5/2012 | Gaus et al. | |
| 8,359,750 | B2 * | 1/2013 | Tran | 29/897.3 |
| 2007/0089763 | A1 * | 4/2007 | Paintner | 134/56 D |
| 2007/0131260 | A1 * | 6/2007 | Scheringer et al. | 134/61 |
| 2007/0240738 | A1 * | 10/2007 | Heissler et al. | 134/18 |
| 2009/0120465 | A1 * | 5/2009 | Peukert et al. | 134/30 |
| 2009/0242005 | A1 * | 10/2009 | Gaus et al. | 134/57 D |
| 2010/0064541 | A1 * | 3/2010 | Slack et al. | 34/92 |
| 2011/0047813 | A1 | 3/2011 | Kuhl et al. | |
| 2012/0096716 | A1 * | 4/2012 | Tran | 29/897.3 |

FOREIGN PATENT DOCUMENTS

| | | | | | |
|---|---|---|---|---|---|
| DE | 103 34 792 | | | 2/2005 | |
| DE | 10 2008 009 784 | | | 8/2009 | |
| EP | 2 108 299 | | | 10/2009 | |
| EP | 2469206 | | * | 9/2013 | |
| GB | 1406110 | A | * | 9/1975 | |
| JP | 09119729 | A | * | 5/1997 | F25B 9/00 |
| WO | WO 2010024552 | A2 | * | 3/2010 | |

* cited by examiner

METHOD AND DEVICE FOR DRYING HUMID AIR

CROSS REFERENCE TO RELATED APPLICATION

This application is a continuation of U.S. patent application Ser. No. 13/817,328 filed on Feb. 15, 2013.

BACKGROUND OF THE INVENTION

1. Field of the Invention

The invention relates to a method for drying moisture-laden air from a working chamber of a water-bearing machine, in particular a dishwasher, and also to an apparatus for drying moisture-laden air from a working chamber of a water-bearing machine.

2. Description of the Related Art

Water-bearing machines or appliances include, in particular, dishwashers and tumble dryers for domestic or commercial use. Said machines are often intended to be installed in a row of kitchen cabinets and have an appliance door on their front face. A plinth is located beneath the appliance door.

Both dishwashers and tumble dryers generally use washing and drying programs which are predefined by a control system of the appliance and are then executed by the components which are incorporated in the appliance. Components of the appliances include, in particular, pumps, fans, valves or, for example, a heating system in this case.

In the case of dishwashers, these programs which are to be executed also comprise, in particular, program steps in which a washing liquid, for example water admixed with washing agent, is distributed over the dishes by a circulation pump in the working chamber of the appliance and then conveyed out of the working chamber again, into a detergent solution outlet. The completion of a washing process is formed by a drying program section in which the moisture has to be removed from the working chamber as far as possible in order to dry the dishes.

The same object of drying products that are located in the working chamber is encountered in a tumble dryer.

Systems which operate in accordance with the circulated-air principle or the discharge-air principle, or with both principles in combination, are known for drying purposes.

In the exhaust-air drying system, the drying process is supported by ventilation of the working chamber by moisture-laden air being discharged from the working chamber to the area surrounding the appliance. At the same time, cold ambient air is admixed with the process air in the working chamber. To this end, an opening is required in the appliance, in particular in the door or plinth of said appliance.

The known circulating-air drying systems use condensation surfaces in a circulating-air circuit for the drying process. Condensation surfaces used are the comparatively cool outer surfaces of the appliance or else the inner surfaces of the working chamber itself. It is also known to cool these condensation surfaces using fresh water. In this case, the moisture-laden air itself is heated to the greatest extent possible in the working chamber so that it can absorb a large amount of steam. In order to achieve good, and in particular excellent, drying results, it is necessary in the case of known appliances for these appliances to operate with the moisture-laden air in the working chamber at a temperature of approximately 65 degrees Celsius (° C.).

The invention is based on the object of providing a method and an apparatus for drying moisture-laden air, which method and apparatus allow drying results which, as far as possible, are better than known appliances and, at the same time, lower operating costs.

SUMMARY OF THE INVENTION

According to the invention, this object is achieved by a method for drying moisture-laden air from a working chamber of a water-bearing machine, in particular a dishwasher, comprising the steps of: setting the temperature of the moisture-laden air in the working chamber to between 40° C. and 50° C., setting the temperature of a cooling medium in a heat exchanger to less than 20° C., and conducting the moisture-laden air, of which the temperature has been adjusted in this way, out of the working chamber through the heat exchanger.

According to the invention, the temperature of the air in the working chamber is only comparatively slightly adjusted for drying purposes. This contrasts with conventional methods in which the process is performed at initial drying temperatures of generally between 65° C. and 70° C. As a result, a large amount of heating energy is saved according to the invention since, in said appliances, each degree of heating requires a heating power of several watts on average. At the same time, a heat exchanger is used in the invention, said heat exchanger being arranged separately from the working chamber and particularly efficient dissipation of heat from the moisture-laden air taking place in said heat exchanger. As a result, a particularly high proportion of steam condenses out of the moisture-laden air and excellent drying results are achieved without a large amount of energy being expended. To this end, water at a temperature of below 20° C. is supplied to the heat exchanger.

Fresh water, of which the temperature has been correspondingly adjusted, is advantageously provided as the cooling medium in the heat exchanger. As an alternative, stored residual water at temperatures which can initially also be above 20° C. from a preceding washing cycle can also advantageously be used.

The cooling medium is preferably cooled before it is provided in the heat exchanger. The cold of a device which generates cold and heat is advantageously used for cooling purposes, the heat from said device at the same time being used for heating purposes.

Furthermore, the cooling medium is advantageously cooled by means of a circuit on an ice storage means. The ice storage means serves as a cold storage means to and from which energy can be supplied in good time depending on the desired program sequence.

A heating medium is preferably provided in the heat exchanger, wherein the moisture-laden air is conducted out of the working chamber in the heat exchanger in particular initially past the cooling medium and then past the heating medium. Moisture is thereby advantageously removed from the air by cooling and said air is then preheated again in order to again absorb steam in the working chamber.

The object is also achieved by an apparatus for drying moisture-laden air from a working chamber of a water-bearing machine, in particular a dishwasher, which is designed to set the temperature of the moisture-laden air in the working chamber to between 40° C. and 50° C., to set the temperature of a cooling medium in a heat exchanger to less than 20° C., and to conduct the moisture-laden air, of which the temperature has been adjusted in this way, out of the working chamber through the heat exchanger.

Fresh water, of which the temperature has been correspondingly adjusted, is preferably provided as the cooling medium in the heat exchanger.

The cooling medium is advantageously cooled before it can be provided in the heat exchanger.

In this case, the cooling medium is particularly preferably cooled by means of a circuit on an ice storage means.

A heating medium is also preferably provided in the heat exchanger, wherein the moisture-laden air in the heat exchanger can be conducted in particular initially past the cooling medium and then past the heating medium.

Exemplary embodiments of the solution according to the invention will be explained in greater detail below with reference to the appended schematic drawings.

DETAILED DESCRIPTION OF THE PREFERRED EMBODIMENTS

Figure 1:
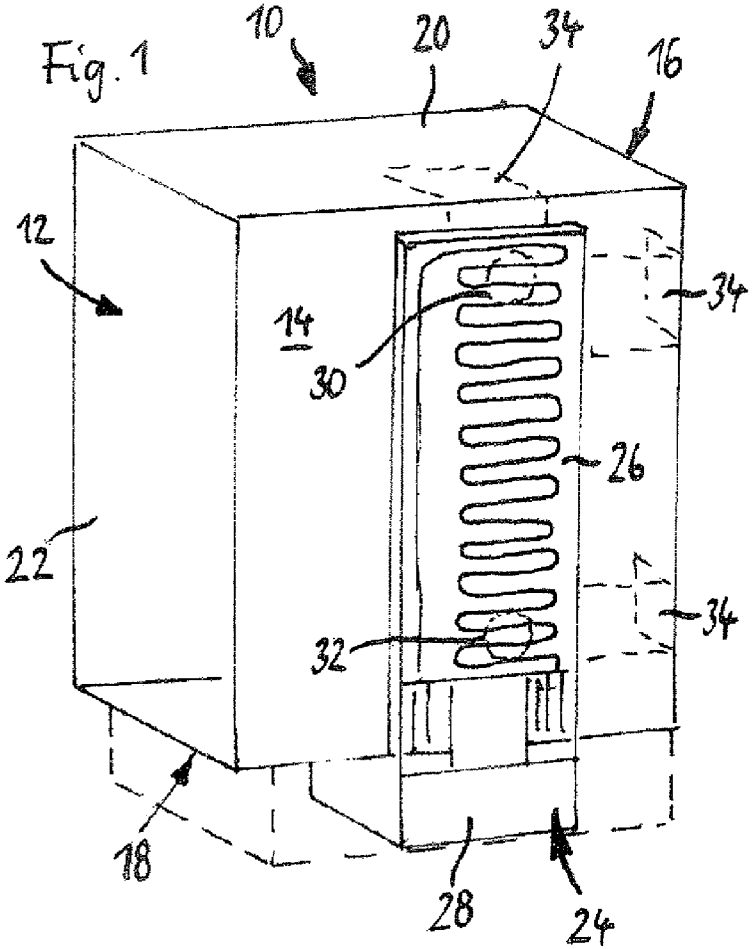
FIG. 1 shows a perspective view of a dishwasher having a first exemplary embodiment of an apparatus according to the invention for drying moisture-laden air.

FIG. 1 shows a dishwasher 10 which contains a cubic working chamber 12. The working chamber 12 is bounded by two side walls 14, a rear wall 16, a base surface 18 and a top surface 20. The resulting front face 22 of the working chamber 12 can be selectively opened and closed by means of a door—not shown.

An apparatus 24 which, amongst other things, is provided particularly for drying moisture-laden air which is produced in the working chamber 12 in specific operating states is located on the working chamber 12. Said drying takes place, in particular, at the end of a program sequence in the dishwasher 10 in which the dishes which are then located in the working chamber 12 are intended to be dried and freed of any remaining water without leaving residues.

In an exemplary embodiment—not illustrated—the appliance which is equipped with the apparatus 24 is a tumble dryer in which moisture is then intended to be removed from the moisture-laden air which is located in the working chamber by means of the apparatus 24 over virtually the entire operating period.

The apparatus 24 is designed with a heat exchanger 26 and a control device 28 by means of which a variety of fluid streams can be supplied, in particular, to the heat exchanger 26.

In this case, the heat exchanger 26 has an upper opening 30 in the direction of the working chamber 12 and also has a lower opening 32. In the exemplary embodiment illustrated in FIG. 1, the openings 30 and 32 are located together with the heat exchanger 26 on one of the side walls 14. As an alternative or in addition to this arrangement of the openings 30 and 32, connections 34—shown in dashed lines in FIG. 1—can be provided, said connections then establishing a flow path between the rear wall 16 and the top surface 20 and/or the base surface 18 and the heat exchanger 26. These connections 34 can be coupled to the heat exchanger 26 in a multipartite manner in the form of angled, flat channels or can be integrally formed with said heat exchanger.

Figure 2:
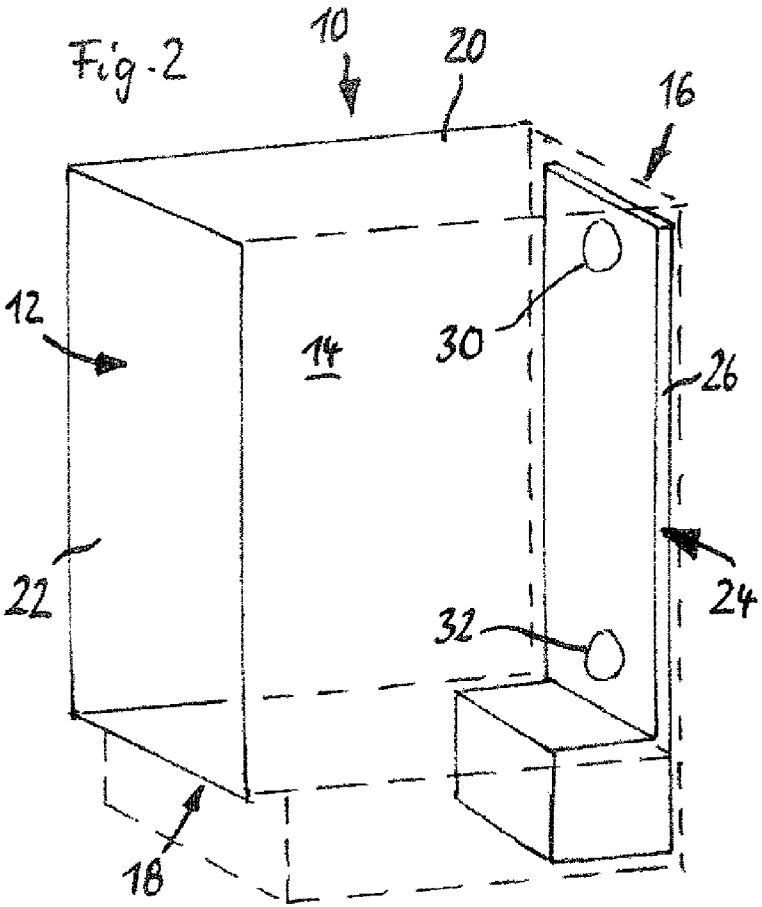
FIG. 2 shows a view according to FIG. 1 of a second exemplary embodiment of an apparatus according to the invention for drying moisture-laden air.

FIG. 2 shows an exemplary embodiment of a heat exchanger 26 which is arranged on the outside on the rear wall 16 of the associated dishwasher 10. This arrangement has proven particularly advantageous in respect of the achieved drying result. The reason for the particularly good drying result achieved in this way is that the openings 30 and 32 which are arranged on the rear wall 16 produce a particularly expedient circulation flow of the moisture-laden air within the cubic working chamber 12. This circulation flow is very good particularly when the flow of air is routed through the lower opening 32 out of the working chamber 12 and into the heat exchanger 26 and the upper opening 30 returns the air, from which moisture has then been removed, from the heat exchanger 26 to the working chamber 12. In this respect, it is important, specifically, for the air on the front face 22 to be cooled to a greater extent than on the side walls 14 and on the rear wall 16 on account of poorer insulation on said front face and the seals on the door. The air which is cooled in this way accordingly drops downward in the front of the working chamber 12 and is then advantageously drawn off toward the rear through the lower opening 32.

Figure 3:
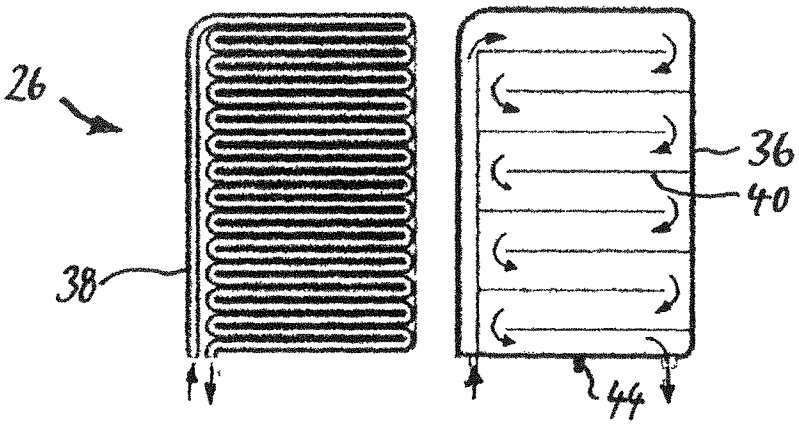
FIG. 3 shows a side view of the inner and outer part of a first exemplary embodiment of a heat exchanger of an apparatus according to FIG. 1 or 2.
Figure 4:
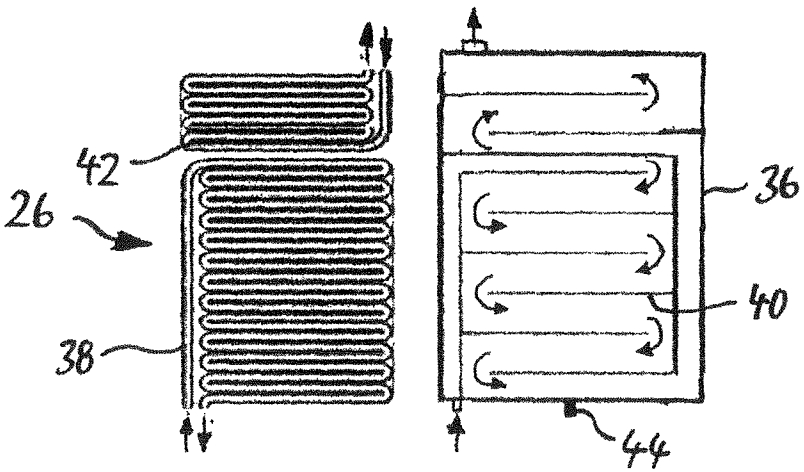
FIG. 4 shows a view according to FIG. 3 of a second exemplary embodiment of a heat exchanger of an apparatus according to FIG. 1 or 2.

As illustrated in FIGS. 3 and 4, the heat exchanger 26 is designed with a blow-molded outer casing 36 and an internal, likewise blow-molded, line 38. As an alternative, these blow-molded parts can advantageously also be produced by means of an injection-molding, thermoforming or other plastic shaping method. In this case, the outer casing 36 has internal webs 40 and the line 38 is laid in a sinuous or meandering manner between these webs 40, this resulting in a particularly long flow path and therefore a large heat exchange area.

In the exemplary embodiment according to FIG. 3, an individual line 38 is located in the associated outer casing 36, whereas, in the exemplary embodiment according to FIG. 4, a second, likewise meandering, line 42 is provided in the associated outer casing 36 outside the line 38. This line 42 forms a second heat exchange circuit, with the result that a heat exchanger 26 of this kind can initially cool a fluid, in particular, which is located in the outer casing 36, by means of the line 38 and can then heat said fluid by means of the line 42.

A condensate outlet or condensate separator 44 is formed on the base of each of the heat exchangers of this type according to FIGS. 3 and 4, it being possible for condensate which has cooled in the outer casing 36 to be collected by means of said condensate outlet or condensate separator.

Figure 5:
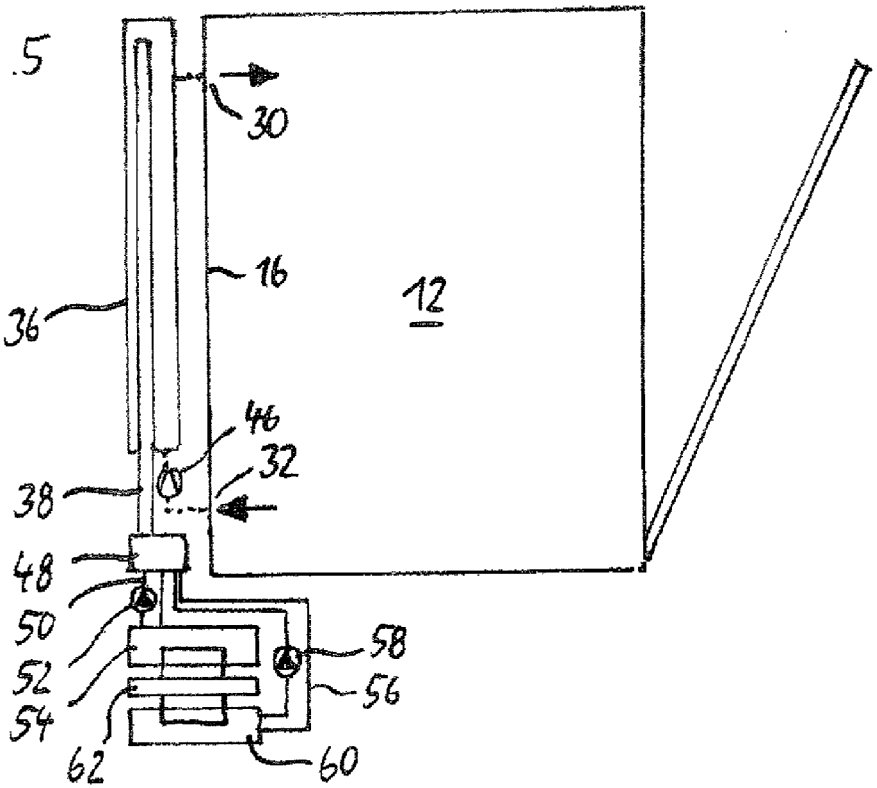
FIG. 5 shows a diagram of a first variant embodiment of an apparatus according to FIG. 1 or 2.

The arrangement of a heat exchanger 26 on a working chamber 12 with the associated openings 30 and 32 is illustrated once again in FIG. 5. FIG. 5 also shows that the above-mentioned process of drawing off moisture-laden air into the heat exchanger 26 is performed by means of a fan 46 (in the present case advantageously by means of a radial fan) which generates a vacuum in the working chamber 12 for this purpose.

FIG. 5 also shows that the internal line 38 of the heat exchanger 26 is preferably arranged on that side which faces the working chamber 12, further away from the inner face of the outer casing 36 than on that side which faces the outside. This asymmetrical arrangement of the line 38 within the outer casing 36 results in an expedient, low-resistance flow of the moisture-laden air in the outer casing 36 and a large heat exchange area still remains. Furthermore, better insulation of the internal line 38 in relation to, in the present case, the rear wall 16 of the working chamber 12 (or in alternative embodiments in relation to one of the side walls 14) is thus established. Therefore, good insulation in relation to these walls of the working chamber 12 is desired according to the invention because the condensation of the water which is located in the moisture-laden air is intended to take place in a deliberate manner in the heat exchanger 26 and not, for example, on the walls of the working chamber 12 according to the invention. To this end, the heat exchanger 26 is further preferably surrounded by a thermal insulation layer. This thermal insulation also leads to a fluid, which is located in the heat exchanger 26, maintaining its energy level for a long period of time and as a result (residual) thermal energy can also be passed on from one washing cycle to the next.

Finally, FIG. 5 also illustrates a first variant embodiment of the rest of the apparatus 24 specifically particularly of the associated control device 28. For example, the control device 28 according to FIG. 5 is provided with a valve 48 to which the line 38 is connected. A first line circuit 50, in which a pump 52 is arranged, leads to this valve 48. The line circuit 50 is routed through a heat storage means 54 from which thermal energy can be drawn, by a medium which flows in the line circuit, during operation of the pump 52. Given corresponding switching of the valve 48, this thermal energy can be conducted into the heat exchanger 26 by the medium.

A line circuit 56 is also connected to the valve 48, it being possible for a pump 58 to convey a medium which carries cold (or dissipates heat) through said line circuit. In this case, the medium is routed through a cold storage means 60 by the line circuit 56.

A device 62 for generating cold and heat, which is designed particularly by means of a Peltier element in the present case, is located between the heat storage means 54 and the cold storage means 60. As an alternative to a Peltier element, the device 62 can be formed in the conventional manner by a compressor/expansion circuit.

Figure 6:
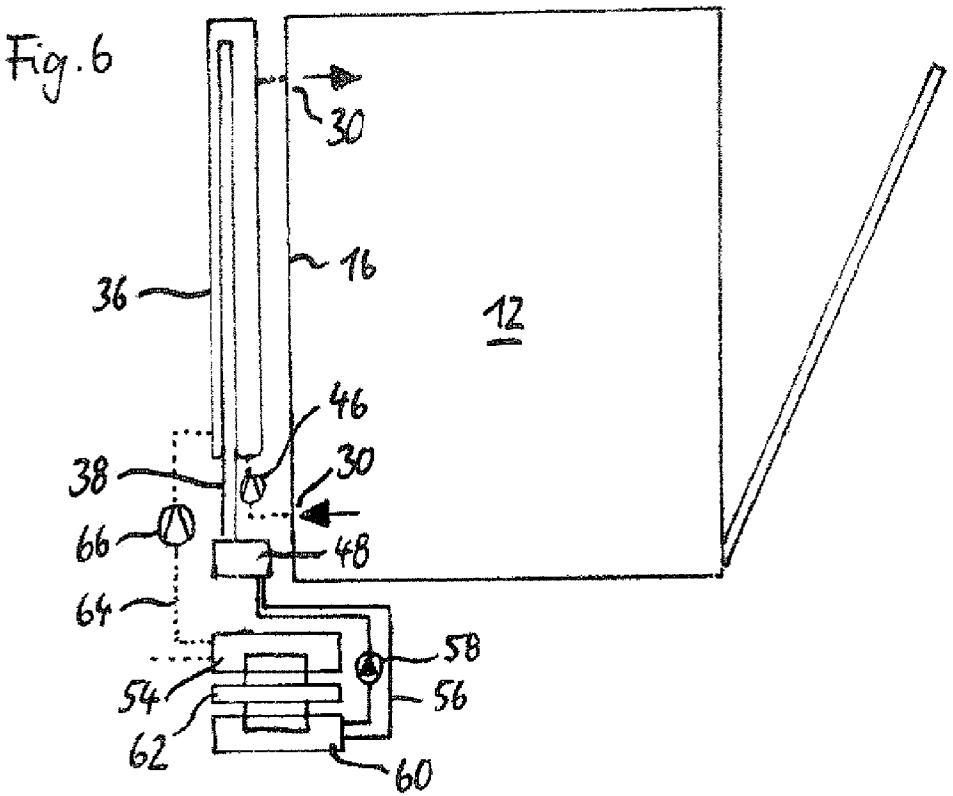
FIG. 6 shows a diagram according to FIG. 5 of a second variant embodiment of an apparatus according to FIG. 1 or 2.

FIG. 6 shows a variant embodiment of an apparatus 24 which is likewise designed with a cold storage means 60 and a heat storage means 54. However, the heat storage means 54 is not coupled to the heat exchanger 26 by means of a line circuit for a fluid, in particular a liquid heat exchanger medium, but rather via an air line 64 which is routed from the area surrounding the dishwasher 10 (as shown) to the heat storage means 54 or (as not shown) from the working chamber 12 to the heat storage means 54. The air line 64 is then routed further through the heat storage means 54 and into the heat exchanger 26, wherein a fan 66 which is arranged there can exact this air flow in the air line 64. The fan 46 already described can be used as the fan 66 by the air line 64 and also the lower opening 32 being coupled to a valve (in particular the valve 48). The valve can then switch the corresponding line paths in such a way that air can be conveyed out of the surrounding area or out of the working chamber 12 through the heat storage means 54, heated in the process and then conveyed, in particular, into the outer casing 36 of the heat exchanger 26. In this case, the heat which is dissipated out of the heat storage means 54 can be used in this way to heat the air in the working chamber 12, in particular in associated program steps, or to preheat or heat water, in particular fresh water, which can then be located in the line 38 of the heat exchanger 26.

As an alternative to supplying the warm air from the heat storage means 54 to the heat exchanger 26 by means of a fan 66, this air can also be supplied directly to the working chamber 12 in a variant embodiment which is not shown. Therefore, the air temperature in the working chamber 12 can likewise be increased and the absorption capacity for steam can be increased in this way.

Figure 7:
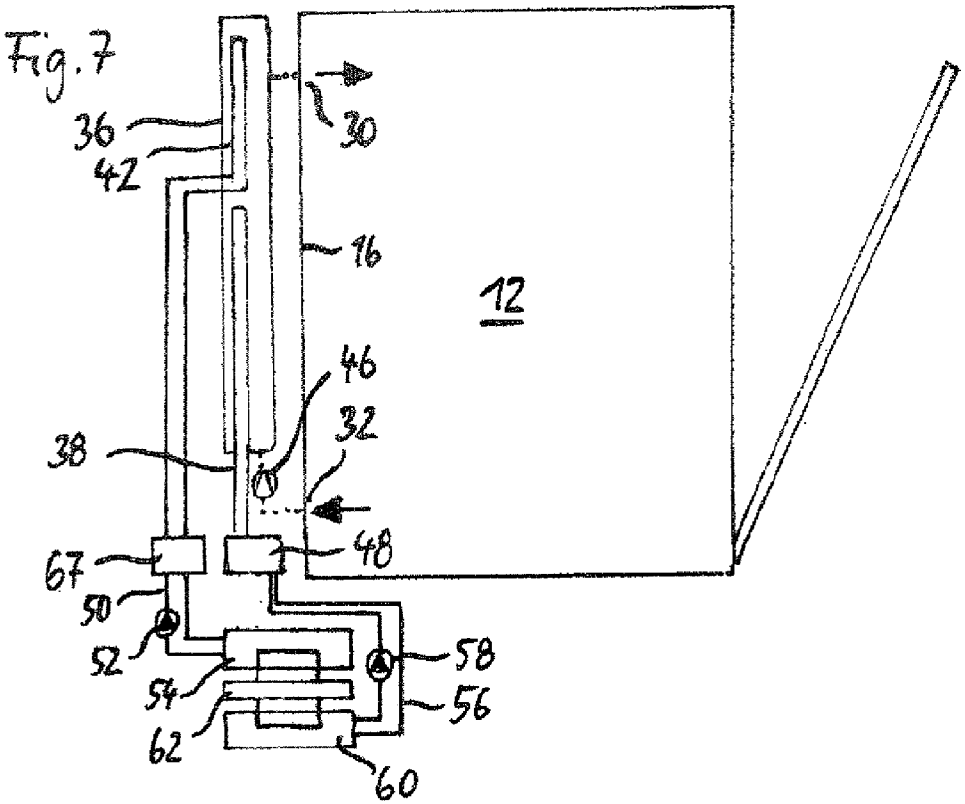
FIG. 7 shows a diagram according to FIG. 5 of a second variant embodiment of an apparatus according to FIG. 1 or 2.

FIG. 7 shows a variant embodiment of an apparatus 24 in which a line circuit 50 for heat dissipation with a pump 52 arranged therein is likewise provided on the heat storage means 54. However, this line circuit 50 is connected to the internal, upper line 42 of the heat exchanger 26 by means of a dedicated valve 67. At the same time, an internal, lower line 38, which can be selectively coupled to the cold storage means 60 in a fluid-conducting manner by a valve 48, is located in the heat exchanger 26. With the heat storage means 54 and cold storage means 60 which are coupled to the heat exchanger 26 in such a way, moisture-laden air from the working chamber 12 can initially be cooled in the heat exchanger 26 and, in this way, the steam located therein can be condensed out in corresponding program steps of the dishwasher 10, in particular on the lower line 38. The air can then be reheated on the line 42, before being returned to the working chamber 12.

In a further exemplary embodiment (not illustrated in any detail), a container containing a reversible, dehydratable material, in particular zeolite, is arranged in the region of the line 42 which is located in the heat exchanger 26, it being possible for moisture-laden air from the working chamber 12 to be conducted through said container by means of the fan 46. This is preferably performed after a large portion of the steam has already been separated from the moisture-laden air by cooling on the line 38. The remaining steam is absorbed substantially by the zeolite. In order to desorb the zeolite, this region of the heat exchanger 26 can then be heated by means of the line 42 and the heat storage means 54 connected to it in a subsequent program step, and in this way the water can be separated off from the zeolite again, with the result that the reversible, dehydratable material is again prepared for the next working cycle of removing moisture from the air from the working chamber 12.

Figure 8:
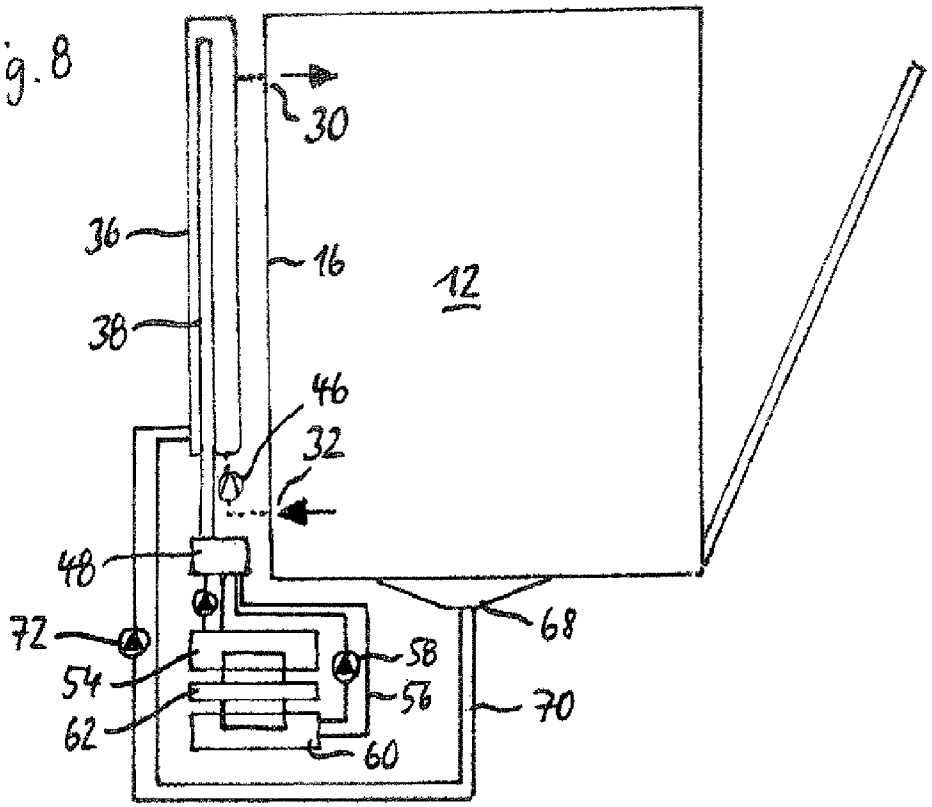
FIG. 8 shows a diagram according to FIG. 5 of a third variant embodiment of an apparatus according to FIG. 1 or 2.

FIG. 8 illustrates the apparatus 24 in a variant embodiment in which a sump 68 with a line circuit 70 and also a pump 72 arranged therein is formed on the base surface 18 of the working chamber 12. As an alternative, and given corresponding connection, the pump 72 can also be replaced by one of the pumps 52 or 58. The line circuit 70 can be connected to a water outlet which is located in the sump 68 and/or on a regeneration device of a water softening means (not shown in any detail). In this case, the line circuit 70 can be coupled to the outer casing 36 of the heat exchanger 26 in a fluid-conducting manner in the present case. As an alternative, the line circuit 70 can also be able to be coupled to the line 38 or the line 42 in the interior of the heat exchanger 26, for example by said line circuit being routed to the valve 48 which is then correspondingly switched. Water which flows out of the working chamber 12 can be temporarily stored in the heat exchanger 26 by way of the line circuit 70 and in the process, in particular, the remaining thermal energy of said water can be used. Furthermore, temperature levels which are desired on the regeneration device can be set by, in particular, cold from the cold storage means 60 or heat from the heat storage means 54 being supplied to said regeneration device. Line coupling via the valve 48 can be used in this case.

Figure 9:
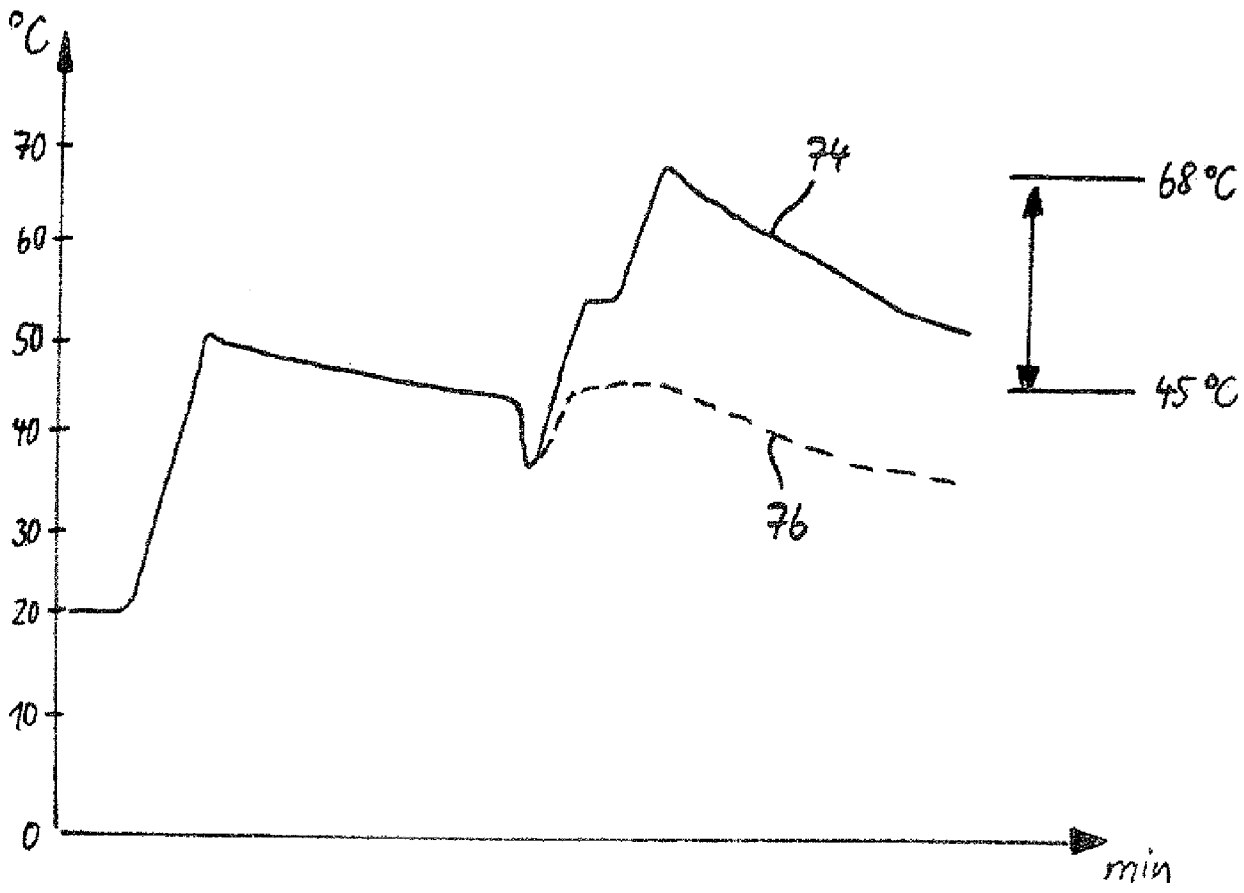
FIG. 9 shows a graph of the time profile of the temperature of moisture-laden air in a working chamber of a dishwasher according to FIG. 1 or 2.

A temperature profile as illustrated in FIG. 9 is controlled in the working chamber 12 with an apparatus 24 of this kind during operation of the associated dishwasher 10. In this case, the temperature is initially increased starting from approximately 20 degrees room temperature to approximately 50° C. by introducing heated water. The water used can be fresh water or residual water which was previously left behind by the last washing cycle and has been temporarily stored, in particular as explained above, in the heat exchanger 26. In this case, the temperature of the water can be preliminarily adjusted or maintained by means of the heat storage means 54. This results in a first potential saving in energy and fresh or unprocessed water in comparison to conventional appliances.

In the subsequent wash cycle, the water and therefore also the air in the working chamber 12 cools down in a substantially linear manner to a temperature of approximately 40 to 45° C. The water is then pumped away, as a result of which the temperature in the working chamber 12 falls further to, for example, approximately 35° C. This temperature is also established, in particular, by fresh water for a final rinsing cycle then being supplied again. In the present case, provision can be made for the last portion of water from the first washing cycle to be temporarily stored in the heat exchanger 26 and for this water to be used for preheating the fresh water in the subsequent final rinsing cycle.

In the case of conventional dishwashers 10 (this is illustrated by a solid curve 74 in FIG. 9), the working chamber 12 and the moisture-laden air which is located therein is heated to a temperature of approximately 68 degrees Celsius (° C.) during the final rinsing cycle. This temperature is required particularly when a particularly good drying result is intended to be achieved in a subsequent drying cycle.

However, this is not necessary with the apparatus 24 according to the invention. Rather, the apparatus 24 makes it possible for the moisture-laden air in the working chamber 12 to have to be heated only to a temperature of between 40° C. and 50° C., in particular between 48° C. and 42° C. (see the dashed curve 76 in FIG. 9 in this respect). The moisture-laden air is subsequently circulated through the heat exchanger 26, specifically by the fan 46. At the same time, water at a temperature of less than 20° C., preferably of between 15° C. and 5° C., is provided in said heat exchanger in the line 38. In this case, the water can advantageously be fresh water that has previously been routed through the cold storage means 60. As an alternative, fresh water which originates from a feed line can also correspondingly be supplied to the heat exchanger 26.

The steam is readily separated out from the moisture-laden air from the working chamber 12 by the cold water of said kind in the heat exchanger 26 in such a way that, as experiments have shown, excellent drying results are produced. At the same time, the only minor temperature adjustment in the working chamber 12 for the final rinse cycle and drying cycle requires a particularly small amount of energy, as a result of which a considerable amount of energy can be saved in comparison to known appliances. Experiments have shown that at least an energy saving of more than 200 watt hours (Wh) per washing program and therefore of more than approximately 50 kilowatt hours (kWh) per appliance and year can be consistently achieved. Furthermore, there is a considerable potential for saving water. Finally, the procedure according to the invention can also shorten the cycle time for drying overall, as a result of which the associated washing program can be shortened by approximately 25 minutes (min). This makes a considerable overall contribution to environmental protection.

In the case of the procedure according to the invention, the system is also closed, and therefore no outlet, for example in the base region of the appliance, is required. The system is therefore also advantageous in comparison to known systems in respect of noise and odor emissions.

Figure 10:
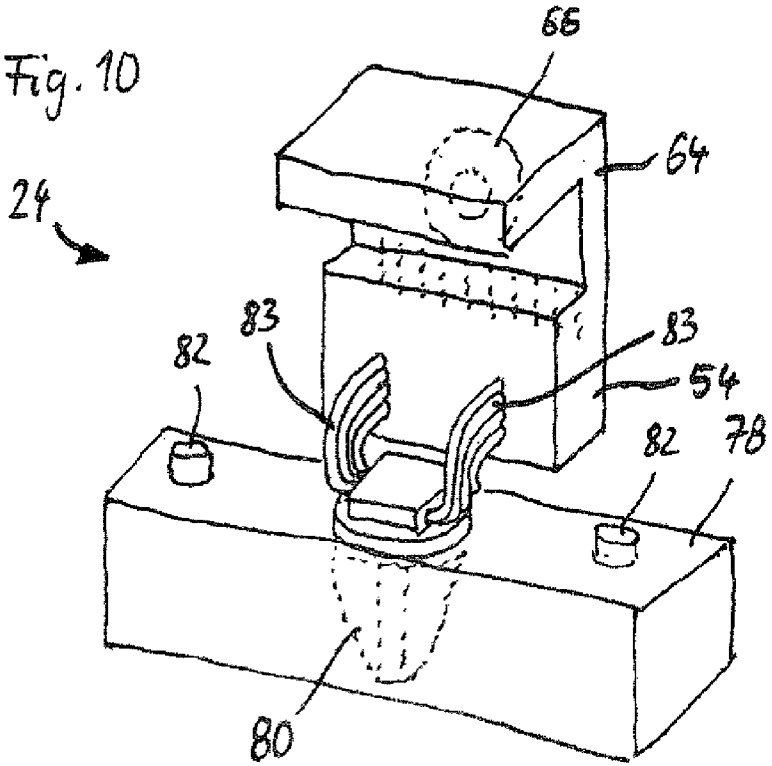
FIG. 10 shows a perspective view of a device for generating cold and heat of an apparatus according to FIGS. 1 to 9.
Figure 12:
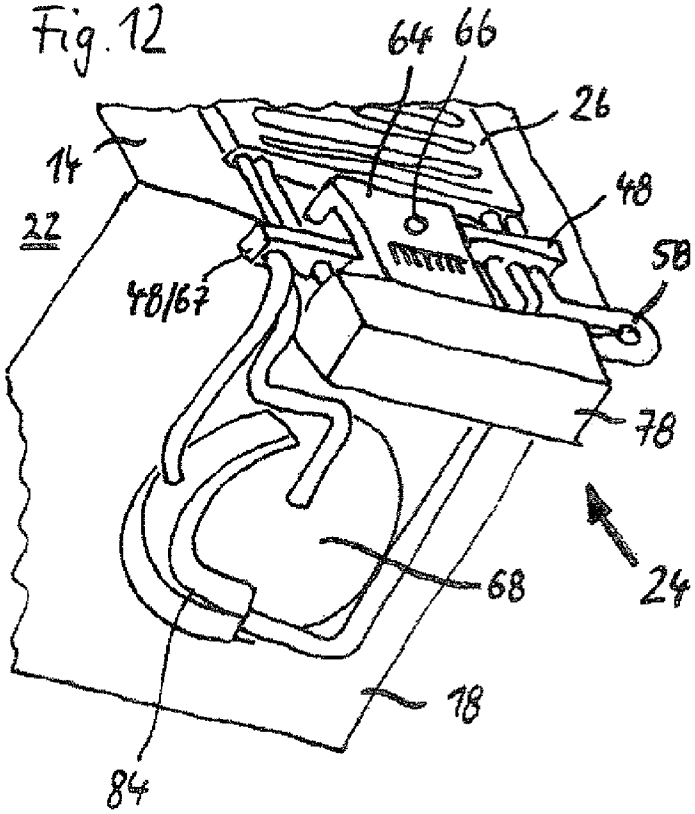
FIG. 12 shows the view XII in FIG. 11.
Figure 11:
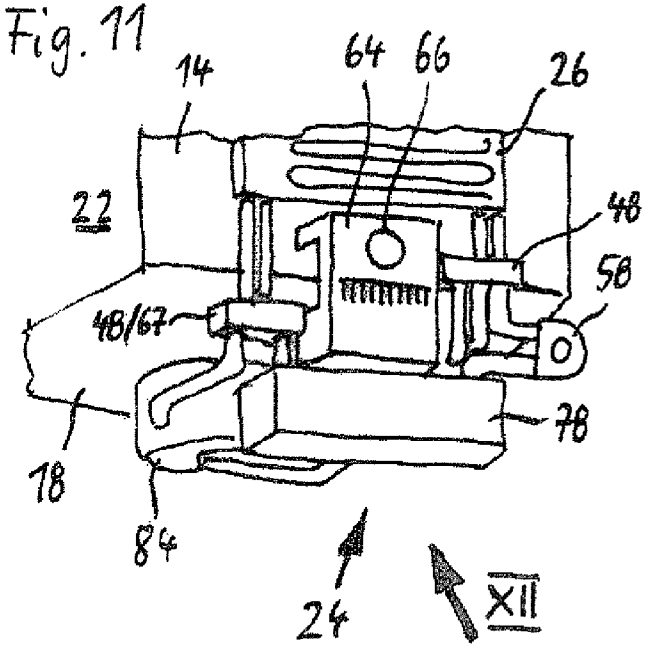
FIG. 11 shows a perspective side view of a dishwasher having a device according to FIG. 10.

FIGS. 10 to 12 illustrate an embodiment of an apparatus 24 in which the cold storage means 60 is formed by means of an ice storage means. The ice storage means comprises a single- or multiple-walled, in particular double-walled, housing 78 on which a single or multiple Peltier element is arranged as a device 62 for generating cold and heat. The Peltier element generates an ice core 80 in the housing 78 as a latent cold storage means, it being possible for a cold medium, in the present case water, to flow around said ice core. In addition, two connections 82 are formed on the housing 78 for conducting water through.

A plurality of heat pipes 83 or other kinds of heat-dissipating elements are arranged on the hot side of the Peltier element, thermal energy being transported away from the Peltier element by means of phase conversion in said heat pipes or elements. In this way, the thermal energy is conducted to a heat storage means 54 which is filled with a phase change material (PCM) in the present case. This material also stores large amounts of heat by experiencing a phase conversion. The phase conversion can be from solid to solid, solid to liquid, liquid to gaseous or solid to gaseous. In this case, the enthalpy of conversion of the phase conversion is very low. A phase change material used is preferably one in which a (partial) fusion process is used as the phase conversion. Before and after the phase conversion, the thermal energy is carefully stored in accordance with the specific thermal capacity of the material. However, the temperature of the material does not change during the phase conversion; the thermal energy is stored in a "hidden" or latent manner. In the present case, preferred materials are those which, in addition to a high enthalpy of fusion, also have a high thermal capacity, such as, in particular, inorganic salts or salt hydrates, the eutectic mixtures thereof and eutectic water/salt solutions and paraffins or sugar alcohols. Furthermore, these materials are flowable in the form of a "slurry" or sludge.

Figure 13:
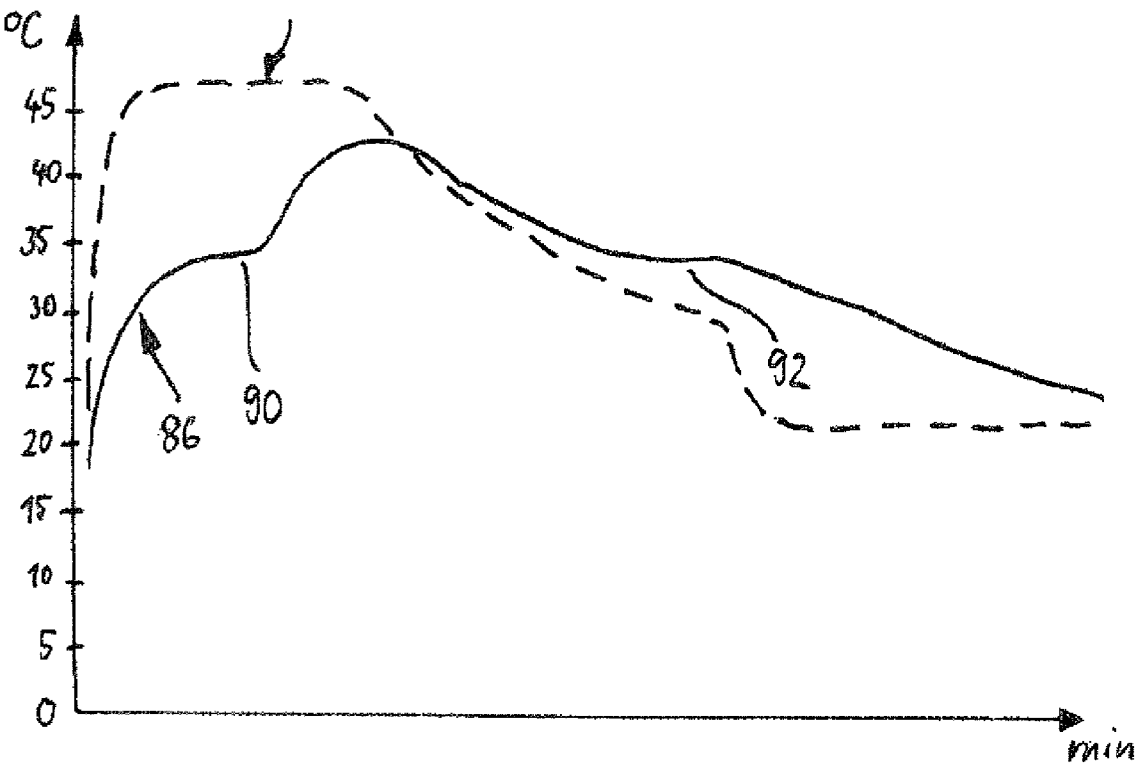
FIG. 13 shows a graph of the time profile of the temperatures of a phase-change material of a device according to FIGS. 10 to 12.

The phase change processes are illustrated in the graph in FIG. 13 which shows the profile of the temperature of the phase material using a solid curve 86 and the profile of the temperature of the associated Peltier heater using a dashed curve 88. Two plateaus 90 and 92 in the curve 88 show those points at which the phase change material fuses (plateau 90) and (at least partially) solidifies or freezes (plateau 92) again.

The heat storage means 54 of this kind can be cooled by an air flow through an air line 64 by means of a fan 66 and in this way the thermal energy of said heat storage means can be dissipated. In this case, the air line 64 can be routed directly into the working chamber 12. FIGS. 11 and 12 also show how the lines in the lower face of the base surface 18 are routed from the sump 68 and a regeneration device 84, which is arranged there, to the valves 48 and/or 67.

Figure 15:
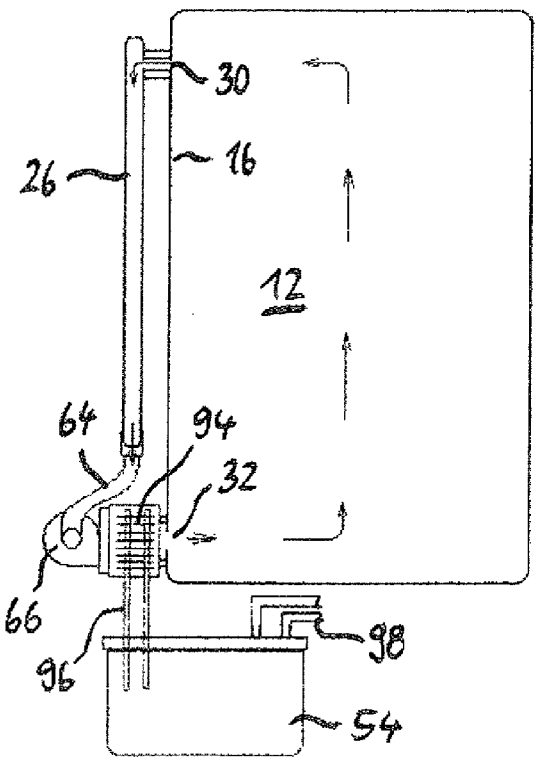
FIG. 15 partially shows the view XV in FIG. 14.
Figure 14:
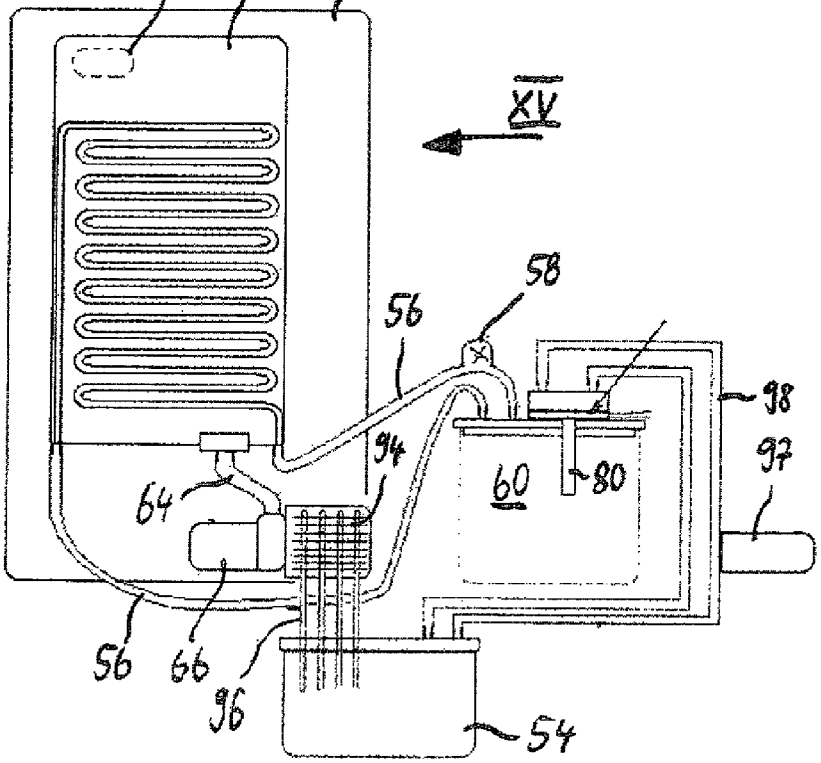
FIG. 14 shows a basic rear view of a further exemplary embodiment of a dishwasher having an apparatus according to the invention.

FIGS. 14 and 15 show an exemplary embodiment of an apparatus in which the heat exchanger 26 is likewise arranged on the rear wall 16 of the working chamber 12. The heat exchanger 26 can be cooled by the line circuit 56 with an associated pump 58 from a cold storage means 60. Furthermore, moisture-laden air can be conveyed out of the working chamber 12 through the heat exchanger 26 by means of the fan 66, wherein the air is drawn into the heat exchanger 26 through the upper opening 30. A further heat exchanger 94 which is connected to the heat storage means 54 via heat pipes 96 is located in the air line 64 of this kind at the lower opening 32. In this case, a phase change material is located in the heat storage means 54 as storage medium, it being possible for said phase change material to be conveyed to the hot side of the associated Peltier element through a line circuit 98 by means of a pump 97.

The heat exchanger 94 can therefore be used to directly heat the air which is blown into the working chamber 12 by means of the fan 66 and therefore to prepare for further absorption of steam.

In conclusion, it should be noted that all the features which are cited in the application documents and, in particular, in the dependent claims, despite the formal dependency references made to one or more specific claims, are also intended to be independently protected individually or in any combination.

What is claimed is:

1. A drying process method for drying moisture-laden process air being discharged from a working chamber of a water-bearing machine, in particular a dishwasher, whereby products to be dried are located in the working chamber, comprising the steps of:

heating the moisture-laden process air which is located in the working chamber to a temperature between 40° C. and 50° C., setting the temperature of a cooling medium in a heat exchanger to less than 20° C., and conducting the moisture-laden process air, of which the temperature has been adjusted, out of the working chamber through the heat exchanger to condense steam out of the moisture-laden air.

2. The drying process method of claim 1, in which fresh water, of which the temperature has been correspondingly adjusted, is provided as the cooling medium in the heat exchanger.

3. The drying process method of claim 1, further comprising the cooling medium before it is provided in the heat exchanger.

4. The drying process method of claim 3, in which the cooling medium is cooled by a circuit on an ice storage means.

5. The drying process method of claim 1, further comprising providing a heating medium in the heat exchanger, wherein the moisture-laden air is conducted out of the working chamber in the heat exchanger initially past the cooling medium and then past the heating medium.

6. A drying process apparatus for drying moisture-laden process air being discharged from a working chamber of a water-bearing machine, in particular a dishwasher, whereby products to he dried are located in the working chamber, which is designed to heat the moisture-laden air in the working chamber to a temperature of between 40° C. and 50° C., to set the temperature of a cooling medium in a heat exchanger to less than 20° C., and to conduct the moisture-laden process air, of which the temperature has been adjusted in this way, out of the working chamber through the heat exchanger to condense steam out of the moisture-laden air.

7. The drying process apparatus of claim 6, which is designed to provide fresh water, the temperature of which has been correspondingly adjusted, as the cooling medium in the heat exchanger.

8. The drying process apparatus of claim 5, which is designed to cool the cooling medium before it can be provided in the heat exchanger.

9. The drying process apparatus of claim 8, which is designed to cool the cooling medium by of a circuit on an ice storage means.

10. The drying process apparatus of claim 6, which is designed to also provide a heating medium in the heat exchanger, wherein the moisture-laden air in the heat exchanger can be conducted initially past the cooling medium and then past the heating medium.

* * * * *